United States Patent [19]

Ginzburg et al.

[11] Patent Number: 4,898,014

[45] Date of Patent: Feb. 6, 1990

[54] ROLL SHIFTING SYSTEM FOR ROLLING MILLS

[75] Inventors: Vladimir B. Ginzburg, Pittsburgh; F. Ronald Vidil, McKeesport, both of Pa.

[73] Assignee: United Engineering, Inc., Pittsburgh, Pa.

[21] Appl. No.: 289,187

[22] Filed: Dec. 23, 1988

[51] Int. Cl.[4] ..... B21B 31/18

[52] U.S. Cl. ..... 72/247; 72/245; 72/20

[58] Field of Search ..... 72/247, 243, 245, 20, 72/21

[56] References Cited

U.S. PATENT DOCUMENTS

| | | | |
|---|---|---|---|
| 3,593,554 | 7/1971 | Swift | 72/238 |
| 3,857,268 | 12/1974 | Kajiwaka | 72/247 |
| 3,902,345 | 9/1975 | Shida | 72/247 X |
| 4,162,627 | 7/1979 | Shida et al. | 72/247 |
| 4,369,646 | 1/1983 | Kajiwaka | 72/243 |
| 4,400,957 | 8/1983 | Carlstedt et al. | 72/247 X |
| 4,543,810 | 10/1985 | Stoy et al. | 72/245 |
| 4,711,116 | 12/1987 | Bald | 72/366 |

FOREIGN PATENT DOCUMENTS

| | | | |
|---|---|---|---|
| 0239004 | 9/1987 | European Pat. Off. | 72/247 |
| 3604133 | 8/1987 | Fed. Rep. of Germany | 72/247 |
| 3638331 | 5/1988 | Fed. Rep. of Germany | 72/247 |
| 0102215 | 6/1985 | Japan | 72/247 |
| 0102216 | 6/1985 | Japan | 72/247 |

*Primary Examiner*—W. Donald Bray

*Attorney, Agent, or Firm*—Parmelee, Miller, Welsh & Kratz

[57] ABSTRACT

The invention relates to a rolling mill of the 4 Hi Mae West type having cylinders for axially shifting the work rolls for a schedule free rolling operation, work roll balance cylinders are mounted in the Mae West blocks and as a result assume a varying off set axially relation with the work roll bearings, a control for the balance cylinders to compensate for the effect the offset conditions would otherwise have on the forces of the balance cylinders to maintain the forces at a predetermined value.

8 Claims, 4 Drawing Sheets

ROLL SHIFTING SYSTEM FOR ROLLING MILLS

BACKGROUND OF THE INVENTION

The present invention relates to a rolling mill, particularly to the type employed to roll flat metal products, such as steel strips. Mills of this type may be provided with roll shifting mechanisms for axially moving the rolls in opposite directions to either prevent objectional roll wear caused by the edges of the strips during rolling or to aid in profile and shape control of the strips during rolling. Roll shifting is presently provided in mills having different numbers of rolls, but is more commonly found in 4 Hi, 5 Hi and 6 Hi mills. For simplicity in explaining the present invention, the invention will be considered in terms of a 4 Hi mill, but it will be understood to be equally applicable to other types of mills having generally similar structures and objectives.

In the past, 4 Hi mills having work roll shifting have generally incorporated two different designs with reference to the roll balance and roll bending piston cylinder assemblies provided to maintain the upper work roll away from the lower work roll when no strip is between the rolls and for exerting a positive or negative force in the vertical direction of the rolling force to aid in shape or profile strip control. The number of cylinders may consist of a single cylinder or one or two pairs per bearing chock and in some cases four pairs, in which in certain cases the pairs are spaced on either side of the axis of the work rolls.

In some of these designs the cylinder or cylinders are mounted in one of the bearing chocks of each pair so as to exert their forces on the other cooperative bearing chock of the work rolls. In this design while the shifting of the rolls does not disturb the fixed relationship between the cylinders and bearings of the rolls, since they move as a unit which is an important advantage in view of the fact that there is no change in the lever arm effect between the cylinders and the roll, it has several serious disadvantages which may be briefly identified is follows: (a) it requires that the usually large number of spare bearing chocks be provided with machined openings for the cylinders. (b) it requires the need of maintenance personnel to connect and disconnect the hydraulic lines during roll changing, and (c) to accommodate roll shifting, it requires providing flexible hoses for the hydraulic lines with all their attending disadvantages.

In the second design the cylinders are mounted in nonmoveable blocks provided in the window of each housing, i.e. the housings are Mae West housings, and exert their forces on both of the opposite pairs of bearing chocks at each roll end, which design eliminates each of the aforesaid enumerated disadvantages. However, since in the latter design during roll shifting the rolls with their bearing chocks move relative to the stationary mounted cylinders, unless compensated for there is created a change in the lever arm effect noted above resulting in an undesirable character of loading of the work roll bearings leading to premature bearing failure.

Most of the above noted characteristics and components are illustrated and in some cases more fully described in the following U.S. Patents: Pat. No. 3,593,554 dated July 20, 1971, Pat. No. 3,857,268 dated Dec. 31, 1974, Pat. No. 4,369,646 dated Jan. 25, 1983, Pat. No. 4,543,810 dated Oct. 1, 1985, and Pat. No. 4,711,116 dated Dec. 8, 1987.

SUMMARY OF THE INVENTION

The present invention provides an improved arrangement for compensating for the aforesaid change in the relationship between the bearing-chocks and the cylinder or cylinders of one or more rolls during roll shifting in a mill design where the cylinders are carried stationary in the mill housings.

More particularly, the invention provides a control means for controlling the applied force exerted by a cylinder, which otherwise changes on the shifting of an associated roll, including means for determining the amount of roll shifting, second determining means operatively associated with the first determining means for determining the amount of change in the force imposed by the cylinder caused by the shifting, and means responsive to the second determining means for effecting a change in the applied cylinder force to maintain the force at a predetermined value.

Still further, the invention provides for the control means to produce signals relative to at least one end of the rolls representative of the determining and responsive means, which includes means for relating the forces of at least two of the aforesaid cylinders in a manner that the net result of the forces are controlled to compensate for the change in the forces of the cylinders that would otherwise take place during the shifting of a roll.

DETAIL DESCRIPTION OF THE INVENTION

Figure 1:
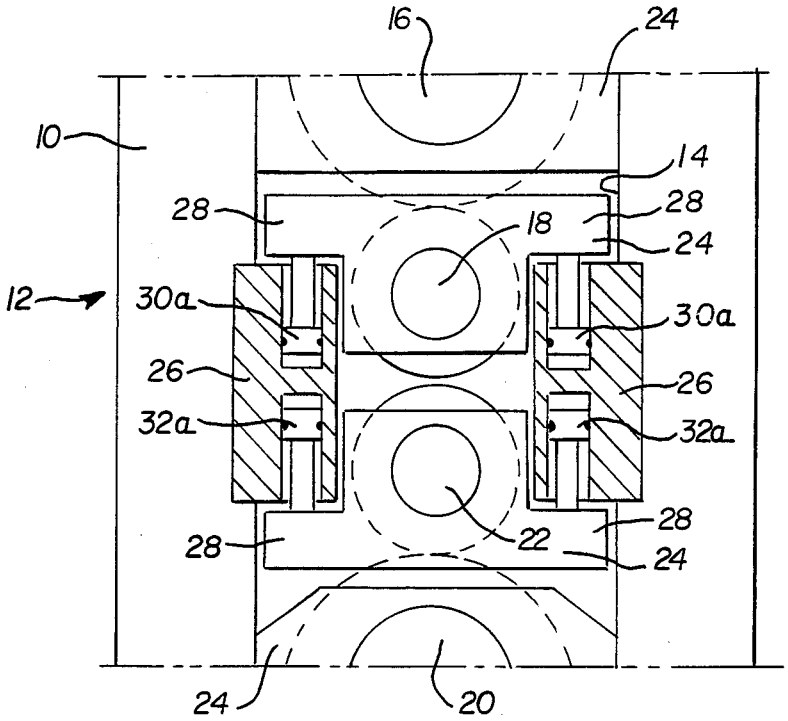
FIG. 1 is a elevational view, partly in section, of the relevant portion of a 4 Hi rolling mill incorporating the features of the present invention.

With reference to FIG. 1, as noted there is illustrated only a portion of a rolling mill incorporating the features of the present invention, since the structural components and operating relationships of the mill in general are well known in the art as evidenced by the several referred to U.S. Patents. There is, however, shown as a beginning point of reference a portion of one of the spaced apart housings 10 of a 4 Hi mill 12, the other housing being of similar construction. The housing has a vertically extending window 14 for receiving an upper and lower roll set, one set consisting of upper back up roll 16, its associated work roll 18, the other of lower back up roll 20 and its associated work roll 22. Each roll is mounted in the window by chock-bearing assemblies (chocks), only a portion being shown of the chocks for the back up rolls as is true of these rolls themselves.

In accordance with the well known Mae West housing construction described above, there is provided fixed opposed Mae West blocks 26 arranged to extend into the window 14 in an overlapping relationship with respect to adjacent horizontal extending portions 28 of the chocks 24 of the work rolls 18 and 22. This construction enables for each portion 28 the mounting of a pair of equal area piston cylinder assemblies (cylinders), FIG. 1 only illustrating one cylinder of each pair, both cylinders of two pairs being shown, however, in FIG. 2, as well as similar pairs of cylinders for the opposite ends of the work rolls mounted in the other housing, not shown.

Figure 2:
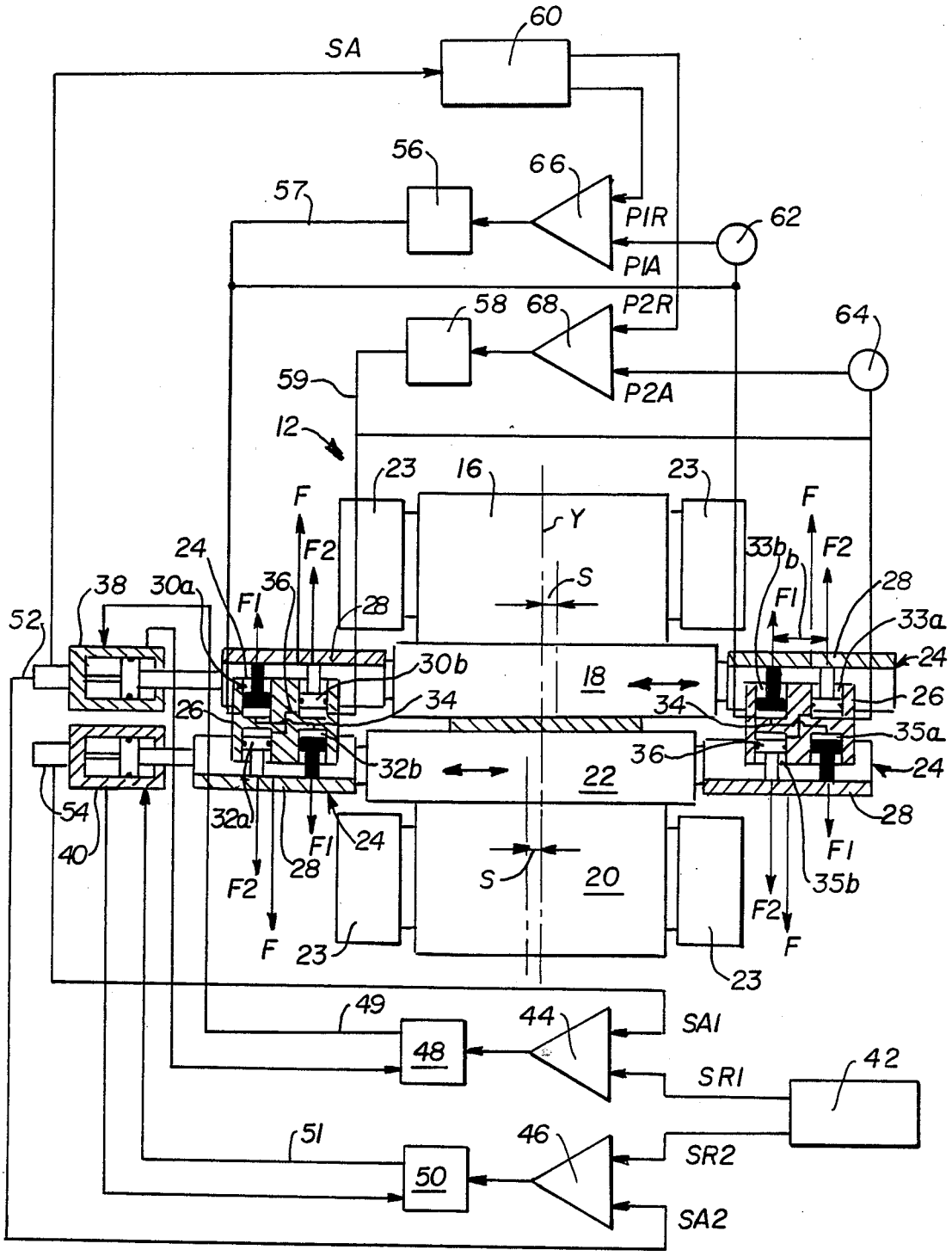
FIG. 2 is a schematic view of a control arrangement for the mill illustrated in FIG. 1.

For ease of understanding, each pair of cylinders have been identified with even numbers as to the cylinders arranged on the left side of the mill, as one views FIG. 2 and odd numbers on the right side, in which the two cylinders of each pair have been legended "a" "b", "a" denoting the axial outer most cylinder of a cooperative pair and "b" the inner most, in which as indicated in FIG. 1, similar cylinders on either side of the roll axes and have been given similar numbers. In still referring to FIG. 2, it will be appreciated that the cylinders of each pair, for example. cylinders 30*a* and 30*b* are arranged on opposite sides of the vertical center of the bearing of the work roll 18 so that on shifting of the roll one cylinder moves toward the center of the bearing while the other moves away.

The identically constructed cylinder assemblies according to usual practice may have a single or dual function, one being the furnishing of the necessary work roll separating force under a no-load condition to maintain the pre set roll gap, this function commonly referred to as "roll balancing", the other being the function of "roll bending" where the cylinders apply to the ends of the work rolls either a negative or positive force to "deflect" the bodies of the rolls for shape and/or profile control of the rolled strip. Hereinafter, when the function of the cylinders are referred to, it is to be understood, that both functional modes are envisioned. In the construction shown, the cylinders apply their forces by having their pistons in contact with the adjacent surfaces of the portions 28.

With reference now to FIG. 2, added to the generally well known components already identified are identical double acting piston cylinder assemblies 38 and 40 shown at the left of FIG. 2, having their pistons connected to the adjacent portions of either the upper or lower work roll chock assemblies 24 for axially moving the work rolls 18 and 22. The maximum axial movement is indicated by both the arrows appearing in FIG. 2 and the reference character S with reference to a mill center line marked "y", it being understood that the cylinders 38 and 40 move the work rolls in opposite axially directions to accomplish a schedule free mode of operation or in other cases a shape and/or strip profile mode of operation.

As noted above, the present invention provides a control arrangement wherein the change in the lever arm effect and hence the force applied by the stationary mounted roll balancing cylinders 30*a* etc. with respect to the axially moveable chocks 24 is compensated for, so that no objectionable loading will be placed on the bearings of the work rolls 18 and 22. FIG. 2 clearly illustrates that on the movement of the work rolls, for example roll 18 a distance S, the distance between the points where the piston rods of cylinders 30*a* and 30*b* contact the chocks changes creating a varying off set condition i.e. the loading with respect to the center of the work roll bearing varies for each step positioning of the roll resulting in an undesirable and varying loading condition on the bearing.

Turning now, in particular, to the control block diagram of FIG. 2, which provides an arrangement for eliminating any undesirable loading of the work roll bearings on roll shifting, the arrangement provides three cooperative interrelated control electro-hydraulic systems. With reference first to the control system for shifting the work rolls 18 and 22, there is provided in an electrical circuitry a computer reference generator 42 that generate reference signals SR1 and SR2, which are received by separate position regulators 44 and 46 for controlling by separate servovalves 48 and 50 the operation of the cylinders 38 and 40, respectively.

During a normal rolling operation, the roll shifting will be automatically initiated as soon as the tail end of the strip leaves the mill. A computer, not shown, will count the number of coils rolled after each roll shift and compare this number with a number set by the operator. When these two numbers are the same, the computer 42 will provide position references SR1 and SR2 to position regulators 44 and 46 which will control through servovalves 48 and 50 connected by lines 49 and 51, respectively, the double-acting roll shifting cylinders 38 and 40. The usual required feedback signals SA1 and SA2 are provided by position transducers 52 and 54.

The position reference signals SR1 and SR2 will correspond to the roll shift pitch set by the operator. The control will step shift the upper and lower work rolls 18 and 22 the same amount in opposite directions up to the maximum stroke of each roll, for example 75 mm. After a full stroke in one direction is utilized, the directions of shifting will be changed.

The two other systems pertain to the pressure control of the sets of cooperative pairs of cylinders formed from the total of sixteen identical cylinders provided, i.e. eight cylinders on the entry side and eight cylinders on the delivery side of the mill, which sides are shown in FIG. 2. In this case the cooperative pair of cylinders are 30*a* and 32*b*, 30*b* and 32*a*, 33*a* and 35*b*, and 33*b* and 35*a*. As indicated in FIG. 2, corresponding cylinders of each pair are interconnected by piping 34 and 36, either in systems of two cylinders or four cylinders. Referring to only two of these pairs, the first of the pressure control systems includes a servovalve 56 for controlling through line 57 the pressure inside the cylinders 30*a* and 32*b* which generate forces denoted as F1. The second system with respect to the other pair includes a servovalve 58 for controlling through line 59 the pressure inside the cylinders 30*b* and 32*a* which generate forces denoted as F2.

Each system, which are essentially identical and have the same pressure ranges, provides it own pressure reference signal P1R and P2R, the signals being generated by computer reference generator 60. Separate feedback signals P1A and P2A for each system are provided from pressure transducers 62 and 64, the signals of which are received by separate pressure regulators 66 and 68 which also receives signals P1R and P2R. The pressure references P1R and P2R are computed by the computer reference generator 60 based on the actual roll shift represented by a signal SA measured by the position transducers 52 and 54. The usually required feedback signals P1A and P2A are also provided by pressure transducers 62 and 64.

In looking now at two cooperative pairs of cylinders at opposite ends of the work rolls with reference to their spaced relation from the center of the bearing, reference is again made to FIG. 2 where attention is directed to cylinders 30*a*, 30*b* and 33*a*, 33*b*. It will be noted that as the bearing chock assemblies 24 at the opposite ends of the upper work roll 18 are shifted to the left a distance, for example of 10 mm, the off set distance of cylinder 30*a* increases while the off set distance of cylinder 33*b* decreases. In recognition of this the corresponding cylinders of each pair are reversed i.e. compare, for example, cylinders 30a–33b and 30b –33a.

The two pressure control systems with there respective F1 and F2 forces allow the forces to be controlled as a function of the roll shift as follows:

$$F1=F(0.5-S/b) \quad (1)$$

$$F2=F(0.5-S/b) \quad (2)$$

Where

F=Total roll bending force per mill side, b=Distance between roll bending cylinders as shown in FIG. 2., and s=Roll shift.

When the forces F1 and F2 follow the Equations (1) and (2), the constant force F will be applied at the center of the work roll bearings throughout the roll shifting range. It will be appreciated that the individual components of the control block diagrams are well known in present day rolling mill control designs and for which reason a detail description will not be given.

Figure 3:
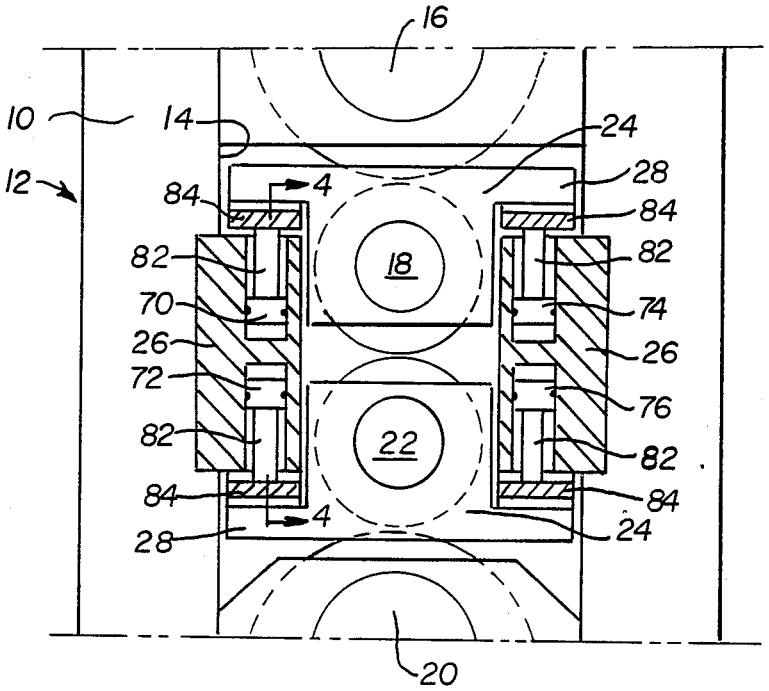
FIG. 3 is a view similar to FIG. 1 of a second embodiment of the invention.
Figure 4:
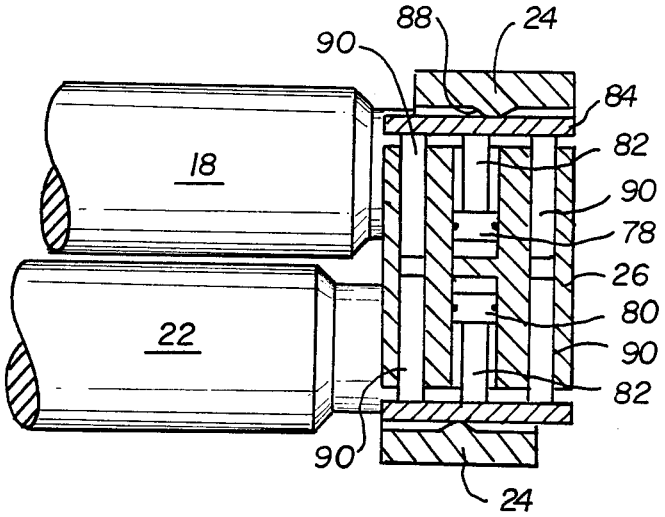
FIG. 4 is a sectional view taken on lines 4—4 of FIG. 3, but showing only one end of the work rolls.
Figure 5:
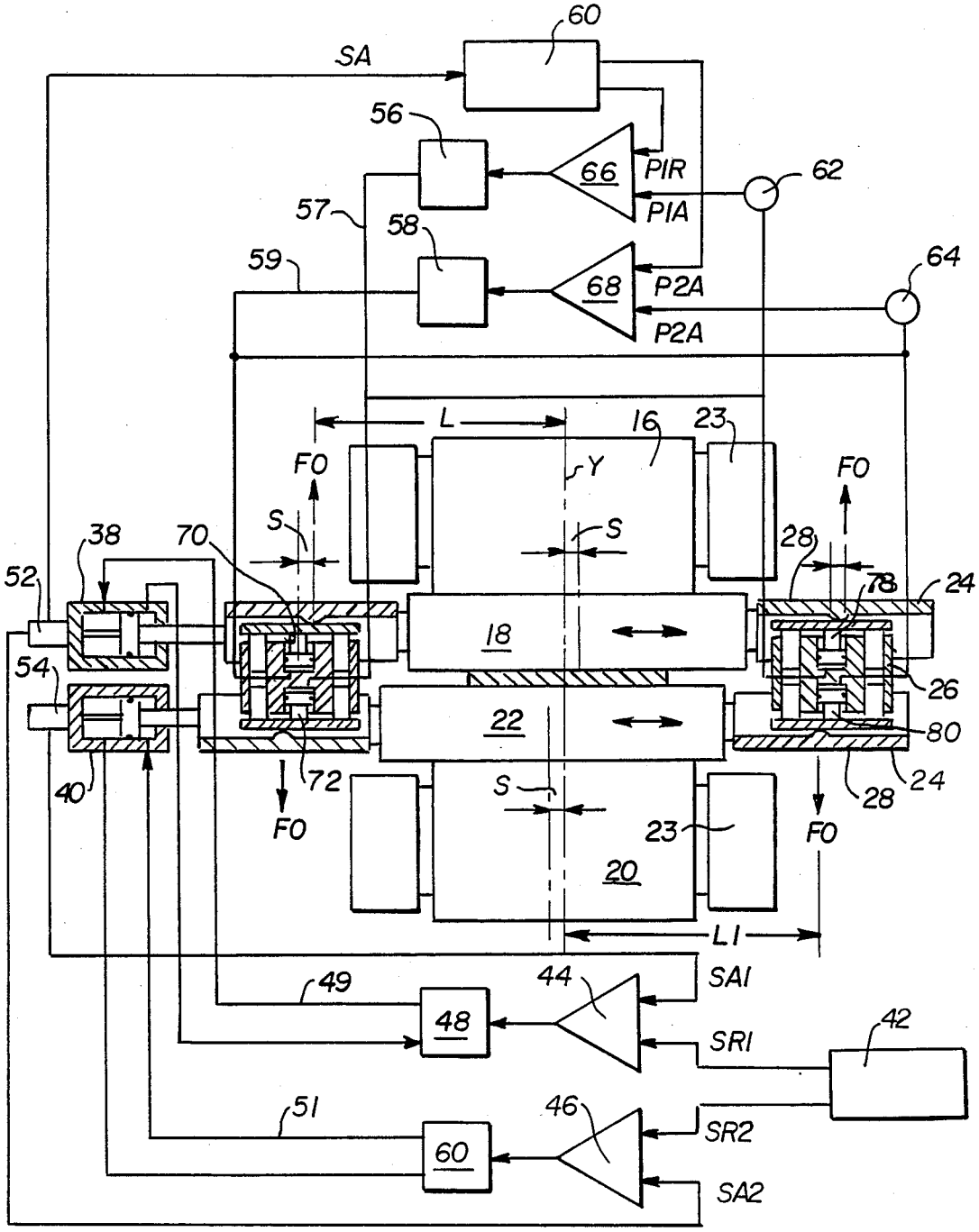
FIG. 5 is a schematic view similar to FIG. 2 of a control arrangement for the mill illustrated in FIGS. 3 and 4.

With reference now to the second embodiment of the invention illustrated in FIGS. 3, 4 and 5. The components common to these Figures and to FIGS. 1 and 2 will bear similar reference numbers. The main difference between the two embodiments is that in the second embodiment instead of providing four cylinders mounted in the Mae West blocks, such as cylinders 30a and 30b for an associated bearing chock assembly 24 a single cylinder for each chock is provided in the blocks at the opposite ends of the work rolls. With reference to FIGS. 3, the single cylinders are designated 70, 72, 74 and 76 as viewed from the window 14 of the mill, and cylinders 70, 72, 78 and 80 when viewed from the entry side of the mill, FIG. 4 also showing the cylinders 78 and 80.

As best shown in FIGS. 4 and 5, the vertically extending piston rods 82 of each cylinders are firmly attached to a horizontal thrust plate 84 which is inserted between the chock 24 and the adjacent end of the rod. The bottom of each chock 24 is formed with a raised rocking surface 88 which permits the plate 84 to tilt or rotate about the vertical center of the surface 88. In this arrangement the thrust plates 84 transmit loads $F^1$ and $F^{11}$ to the work roll chocks 24 though the surfaces 88, this being the case even when the work rolls shift relative to each other to an off center bearing position as shown in FIG. 4. On both sides of each piston rod there is mounted in the Mae West block 26 parallelly arranged guide rods 90 to maintain the rod-plate assembly in a proper operating position.

With reference to FIG. 5, the control block diagram is very similar to the diagram of FIG. 2 as indicated by commonality of the components as designated by the identical reference numbers and other legends. However, since the arrangement of FIG. 5 does not employ the double spaced apart cylinder arrangement of the arrangement of FIG. 2, the "b" factor i.e. the distance between the cooperative cylinders of each pair is eliminated, since in the second embodiment the thrust plates design is provided to take care of the off set bearing loading problem as to the individual chocks. Therefore, the control of this embodiment need only provide for the fact that the distances between the bearings and the cylinders, for example, cylinder 70 compared with cylinder 78, on the opposite ends of the same work roll increase and decrease, respectively. Thus the element "b" of equations 1 and 2 does not appear in the equations and the equations are simplified as follows:

$$F1=F^1(0.5-s) \quad (3)$$

$$F2=F^{11}(0.5+s) \quad (4)$$

It will be appreciated that the present invention can be practiced in different forms and modified from the forms illustrated without departing from the invention.

What I claim is:

1. A rolling mill having a housing with a window formed therein for receiving at least two rolls together with chock assemblies therefore, which rolls generally define an axial direction, said window including immovable guide blocks for said chock assemblies and means for shifting the rolls in opposite axial directions, the improvement comprising:

separating means received in said blocks and operatively associated with said chock assemblies such that said chock assemblies move relative to said separating means in said axial direction, for imposing through said chock assemblies applied forces on the ends of each roll having the tendency to deflect the rolls in the plane of the major component of the rolling force generated by the rolls, whereby shifting at least one roll changes said applied forces; and control means for controlling said applied forces in response to said shifting of at least one of the rolls, including first determining means for determining the amount of roll shifting, second determining means operatively associated with said first determining means for determining the amount of said change caused by said separating means, and means responsive to said second determining means for effecting a change in said applied roll deflection forces to maintain the ultimate effect of said forces at a predetermined value.

2. A rolling mill according to claim 1, wherein said chock assemblies are arranged at the opposite ends of each roll, said separating means comprise piston cylinder assembly means having cylinders disposed in said guide blocks with a piston operatively associated with each chock assembly in a manner that an off set relation exists with respect to said piston cylinder assembly means and a force receiving point of said chock assemblies, said control means include means for producing a signal representative of said change in the applied force caused by said off set conditions, as to each roll, two of said piston cylinders assembly means on opposite ends of the same roll are related to each other so that on said shifting said off set condition increases as to one said piston cylinder assembly means and decreases as to the other of said piston cylinder means, and said responsive means include means for varying the forces applied by said two cylinders assembly means to maintain the ultimate effect of said forces at said predetermined value.

3. A rolling mill according to claim 2, wherein said piston cylinder assembly means comprise for each chock assembly a set of at least two equal area piston cylinders assembly means arranged on both sides of the axes for their associated roll, means for interconnecting said piston cylinders assembly means of one set with the piston cylinders assembly means of a different roll at the same end of the first roll such that the piston cylinders assembly means having the same off set conditions deliver the same forces to their associated chock assembly.

4. A rolling mill according to claim 3, wherein said piston cylinder assembly means are part of a fluid system means, said fluid system means comprising two separate systems for corresponding piston cylinder assembly means of each cooperative sets of piston cylinder assemblies and being capable of delivering to the piston cylinder assembly means the same pressure range, and wherein said roll shifting means includes separate means for each roll, and wherein said first determining means includes separate determining means for each roll, and means for operatively associating said separate determining means with a different one of said fluid system means.

5. A rolling mill according to claim 2, wherein said piston cylinder assembly means comprise a cooperative pair for each chock assembly arranged in spaced relation with respect to the axes of its associated roll, and wherein said control means produces said signal for both ends of said rolls and solves the equations:

$$F1=F(0.5-s/b)$$

$$F2=F(0.5+s/b)$$

where F1 represents corresponding piston cylinder assembly means at the opposite ends of said rolls and F2 represents corresponding different said piston cylinder assembly means at the opposite ends of said rolls, and where:

F=the total said roll deflection force for one end of said rolls, b=the distance between said piston cylinder assembly means of a said set, and s=the amount of said roll shift.

6. A rolling mill according to claim 2, wherein said piston cylinder assembly means for each cooperative pair of opposed chock assemblies are arranged to exert their forces in opposite directions, and wherein said control means produces said signal for both ends of said rolls and solves the equations:

$$F1=F(0.5-s)$$

$$F2=F(0.5+s)$$

where F1 represents corresponding piston cylinder assembly means at the opposite ends of said rolls and F2 represents corresponding different said piston cylinder assembly means at opposite ends of said rolls, and where:

F=the total said roll deflection force for one end of said rolls, and s=the amount of said roll shift.

7. A rolling mill according to claim 2, wherein thrust means are so arranged between each chock assembly and said piston cylinder assembly means received in said associated guide block as to be displaceable relative to said associated guide block, said thrust means including guiding means guided by said associated guide blocks for controlling the direction of the displacement of said thrust means with the displacement of the piston cylinder assemblies.

8. A rolling mill according to claim 1, wherein said means for axially shifting said roll includes a piston cylinder assembly means, said control means including means for effecting the desired amount of said shifting of said roll relative to a data position, said first determining means including position transducer means, said second determining means including computer means, and said means for effecting a change in said force applied by said separating means including pressure transducer means.

* * * * *